US006023866A

United States Patent [19]

Polsky

[11] Patent Number: 6,023,866

[45] Date of Patent: Feb. 15, 2000

[54] TRIPLE-VIEW PICTURE KIT

[75] Inventor: Nathan Polsky, Boynton Beach, Fla.

[73] Assignee: Scratch-Art Company, Inc., Avon, Mass.

[21] Appl. No.: 08/837,466

[22] Filed: Apr. 18, 1997

[51] Int. Cl.[7] ..... G09F 19/14

[52] U.S. Cl. ..... 40/453; 40/788; 40/789

[58] Field of Search ..... 40/427, 453, 788, 40/789; 472/57, 71

[56] References Cited

U.S. PATENT DOCUMENTS

| | | | |
|---|---|---|---|
| 845,798 | 3/1907 | Lehr . | |
| 922,015 | 5/1909 | Miller | 40/453 |
| 1,353,363 | 9/1920 | Simon | 40/453 |
| 2,116,542 | 5/1938 | Sayre . | |
| 2,813,457 | 11/1957 | Gerald . | |
| 2,847,783 | 8/1958 | Anderson | 40/453 |
| 2,850,825 | 9/1958 | Grants . | |
| 2,851,804 | 9/1958 | Roach | 40/789 X |
| 4,002,401 | 1/1977 | Malberg . | |
| 4,233,767 | 11/1980 | Hryhorczuk | 40/453 |
| 4,282,669 | 8/1981 | Rieumont | 40/453 |
| 4,422,253 | 12/1983 | Babberl | 40/453 |
| 4,483,087 | 11/1984 | Stoyanov . | |
| 4,618,523 | 10/1986 | Yoshida . | |
| 5,367,801 | 11/1994 | Ahn . | |
| 5,562,459 | 10/1996 | Durlach . | |

FOREIGN PATENT DOCUMENTS

| | | | |
|---|---|---|---|
| 1012868 | 7/1952 | France | 40/453 |
| 716419 | 10/1966 | Italy | 40/453 |
| 380119 | 9/1932 | United Kingdom | 40/453 |
| 112474 | 2/1941 | United Kingdom | 40/453 |

*Primary Examiner*—Terry Lee Melius
*Assistant Examiner*—Andrea Chop
*Attorney, Agent, or Firm*—Browdy and Neimark

[57] ABSTRACT

A educational and play kit allows the user to place panel strips in staggered array so that different pictures are seen from different angles. The panels are attached in a sheet and can be colored or drawn on; then they are separated; then they are mounted in sequential order (1A, 2A, . . . ; 2A, 2B . . . ) in slots (125) in side (120) of a box frame (100). There are two panel sets (B and C), so when viewed at an angle from the left or right different pictures are seen. In addition, the base (110) of the box frame can have its own picture drawn or mounted under the panels. Assembly markings may be placed on the panels and sides to aid children in placing the panels in order, and the markings may be color-coded for the two panel sets.

9 Claims, 4 Drawing Sheets

TRIPLE-VIEW PICTURE KIT

FIELD OF THE INVENTION

The present invention relates to an entertainment and education device, especially for children, presenting three different pictures all covering the same overall area, which three pictures are independently observable from different viewing positions, and more particularly to a kit for home creation and assembly of such a device.

REVIEW OF THE RELATED TECHNOLOGY

More than one picture (image) may be presented on an image-bearing substrate by dividing its surface into sets of parallel panels, where each set of panels includes the indicia of one picture. In such devices the panels of each set are mutually parallel to one another (though perhaps offset or staggered) but they are disposed at an angle to the panels of another set. For example, alternating panel strips on a flat substrate may incline 45° to the left and 45° to the right, so that when the substrate is viewed from one side at a 45° angle one picture is visible, while the panels bearing the other picture are seen edge-on and that picture is invisible. Shifting the viewing position brings the other picture into view, but without any third picture.

A related type of multiple-picture device uses a grating rather than panels set at different angles. One example is in U.S. Pat. No. 5,367,801. Other devices use movable elements, such as in U.S. Pat. Nos. 845,798 and 4,002,401, or are directed to specialized techniques or apparatus (U.S. Pat. Nos. 2,813,457 and 4,618,523). Multiple-picture devices are common in advertising billboards (e.g. U.S. Pat. Nos. 2,116,542, 2,850,825, and 4,483,087) or the like.

Children find multiple-image devices intriguing because they often do not understand their operation. However, the devices are typically inaccessible to children, e.g. either so far away (as on billboards), or else are so finely made (as in toys and jewelry) that a child cannot see or understand how the devices operate or their structure. Such devices are often made fine so that the image quality is improved; if the panels are very narrow, the "seams" tend to be invisible.

Moreover, even if the child is capable of figuring out the mechanism, the available devices are objects of passive consumption which provide no creative or artistic play for a child, allowing no opportunity for the child to create his or her own creative multi-viewing device or object.

Thus, prior art devices excite curiosity but teach nothing. The prior art has not provided a multiple-panel, triple-picture substrate which a child can understand or with which a child can experiment or utilize his or her artistic talents. Neither does the prior art disclose a kit or any knock-down device which can be easily stored in a reduced space and which is available in an economical, easily assembled format for individual creativity and subsequent display.

SUMMARY OF THE INVENTION

Accordingly, the present invention has an object, among others, to overcome deficiencies in the prior art such as noted above. Rather than being a novelty or gimmick, the present invention is an active play device and a demonstration of the principles involved in multiple-picture substrates.

The invention thus provides a given-area substrate with various panels projecting therefrom which, when viewed from different angles, present different respective composite pictures, in particular three different composite pictures at one time from three sets of picture elements or panels all used at the same time, when viewed from three different positions. The device of the present invention includes an economical means for assembling the panels following simple instructions, and is large enough that the structure is apparent. In particular, the structure of each of the components, including the picture panels and holding device are greatly simplified so as to make available to a child the intriguing experience of producing his or her own triple picture art merely by changing the view position.

BRIEF DESCRIPTION OF THE DRAWING

The above and other objects and the nature and advantages of the present invention will become more apparent from the following detailed description of an embodiments taken in conjunction with drawings, wherein.

DETAILED DESCRIPTION OF THE PREFERRED EMBODIMENTS

Here, and in the following claims:

"panel" means any distinct or demarcated object having a surface bearing indicia by printing, coloring, drawing, and/or any other conventional means, preferably as a portion of a drawing or the like and also preferably in the form of an elongated strip;

"substrate" means a generally flat surface of given overall area on which panels may be superposed, or a mounting frame for holding panels;

"box frame" means either (1) an object reinforcing or surrounding the substrate, or (2) a substrate formed as an open box structure having a bottom and at least two surrounding sides (with or without ends);

"tray" means a base sheet with upturned sides and ends;

"angle" in relation to the plane of a panel refers to the facing direction. Two back-to-back panels whose outside picture surfaces face away from each other are set at an angle of 180° and not 0°; and "foldably joined" refers to either sections of a creased sheet or sheets coupled by flexible members such as tape, a plastic lamina, hinges, and so on.

Figure 1:
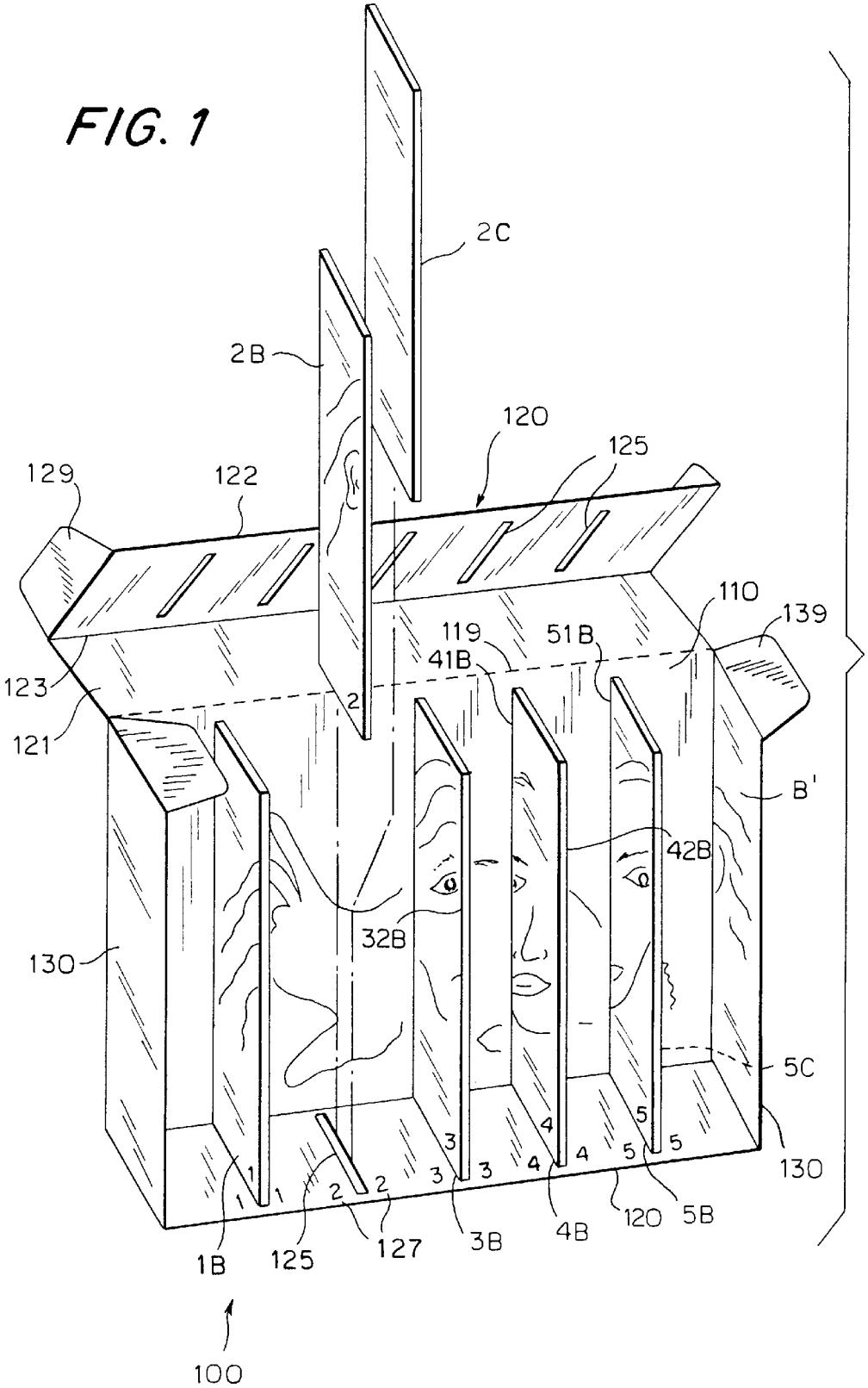
FIG. 1 is a perspective, partially-exploded view of a first preferred embodiment of the present invention.

FIG. 1 shows a triple-picture kit of the present invention in one of its preferred embodiments. A box frame 100, which may be constructed of paperboard or plastic, corrugated paperboard, or similar materials, is constructed in the form of a shallow tray (much like a removable lid for a "cardboard box") having a rectangular bottom or base 110, and is integrally formed with two opposite sides 120 and two opposite ends 130, which sides and ends are folded up about creases and preferably fastened with, for example, glue or staples and reinforced with optional tabs 129 and 139. The side 120 uppermost in FIG. 1 is connected to the bottom 110 by fold line 119 and is shown folded out away from its assembled position to illustrate the structure.

The side 120, for enhanced stiffness, is preferably formed of two sub-sides 121 and 122 joined by a fold line 123. It will be understood that in use the sub-side 121 is rotated about 180° about the fold line 119 from the illustrated position so that the sub-side 122 is inside the sub-side 121 and thus within the outer periphery of the box frame 100. The ends 130 may also be similarly of doubled construction to reinforce the structure. The box frame 100 may also be constructed in a knock-down configuration using lock-tabs, VELCRO, snap fasteners, or other preferably non-permanent fastening means to permit unfolding of the box frame 100 after use and storing it flat (not shown). The ends 130 may be omitted.

The sides 120 are provided with means to releasably hold a series of panels, the latter of which are described below. The box frame 100 thus acts as a support or substrate for a first picture A (illustrated as a rabbit) and a pair of panel sets B and C. The panels of both sets B and C are preferably mounted in the box frame 100 by means of slots 125 in the sides 120, into which the panel ends are inserted, although it will be clear that other conventional panel mounts may be provided. Each panel set B, C is composed of an ordered sequence of panels, preferably numbering about ten to twenty; in the figure each set numbers only five to simplify the illustration.

Figure 2:
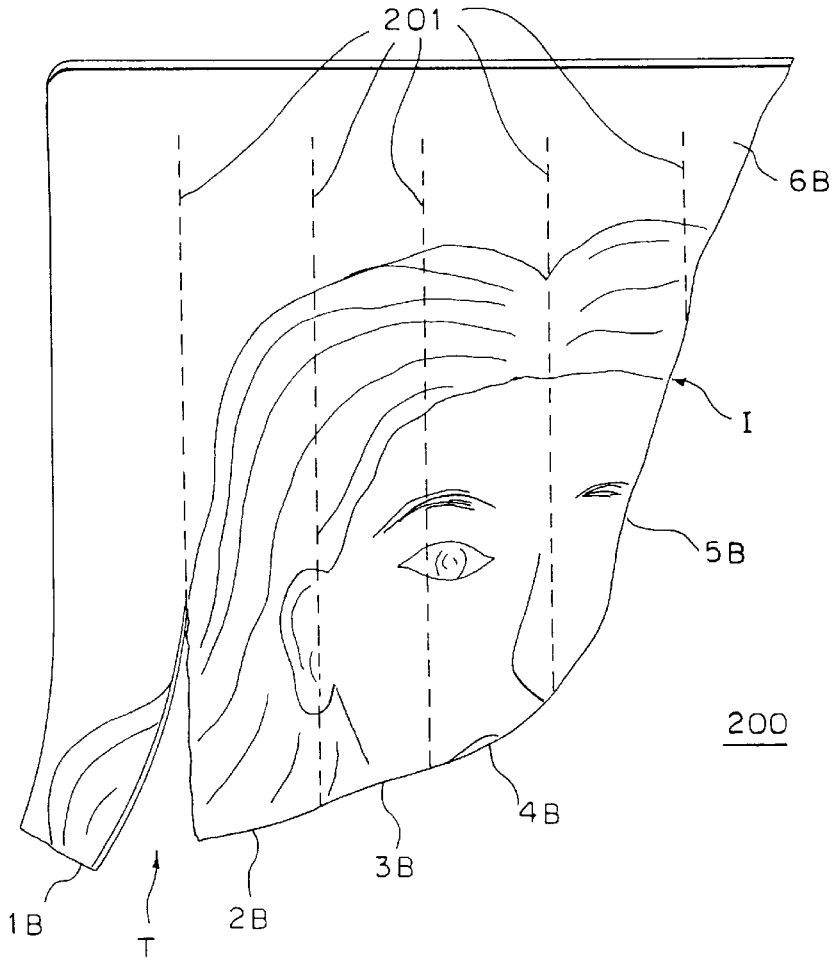
FIG. 2 is a partial plan view of a picture sheet divisable into separate panels for use in the present invention, including the embodiment of FIG. 1.

Each set of panels B and C are formed from a suitable sheet, e.g. paper, card stock, paperboard, plastic, etc. FIG. 2 shows a portion of such a sheet, labeled 200, with indicia I depicting a face in outline, suitable for coloring by the user. Various structures can be used to provide easy separation into separate panels. In FIG. 2 perforations are provided for separating the sheet 200 into separate panels 1B through 6B by means of a tear T, which in the drawing is separating panel 1B from panel 2B. Alternatives to perforations within the scope of the invention include separation marking lines as cutting guides, e.g. on the back of the sheet (not shown); slits extending almost to the edges; removable tape or the like (not shown).

Indeed, separate panels, e.g. of plastic or paperboard, temporarily held edge-to-edge in a holder for drawing or coloring onto as a unit, which avoids the need for separation, may be used. In this latter embodiment, i.e. if the kit includes already-separated panels, then these panels may be insertable in sequence flat into the box frame 100 as a holder to hold them in position for drawing, prior to ultimate assembly as shown in FIG. 1.

The panel sets B and C include indicia on only one outer surface, i.e. the face thereof. When two panels are mounted in the box frame 100 back-to-back as shown with respect to panels 2B and 2C in FIG. 1, the corresponding B and C panels present their indicia to viewers on the left side and the right side respectively. In FIG. 1, the panels 1B, 2B, 3B, 4B, and 5B include indicia comprising a picture of a face, visible to a viewer to the left of the box frame 100. The indicia on panel set C is not visible in FIG. 1.

As illustrated, the panels are mounted perpendicular to the adjacent inner face or base of the box frame 100. When the box frame is viewed from one side at a certain angle which depends on the width and spacing of the panels, a first edge 51B of a last panel 5B, adjacent the bottom 110 of the box frame, aligns with a second edge 41B of a next-to-last panel 4B; and a first edge 41B of the next-to-last panel aligns with the second edge 32B of a third-from-last panel 3B, and so on. Except for minor parallax errors, the panel set edges will appear to be contiguous and the picture will then appear without gaps or overlaps.

The other picture on the opposite sides of the panels appears similarly when the box frame 100 is viewed from the other side. This is shown in FIG. 3, where indicia which together provide the picture of an elephant are shown.

Figure 3:
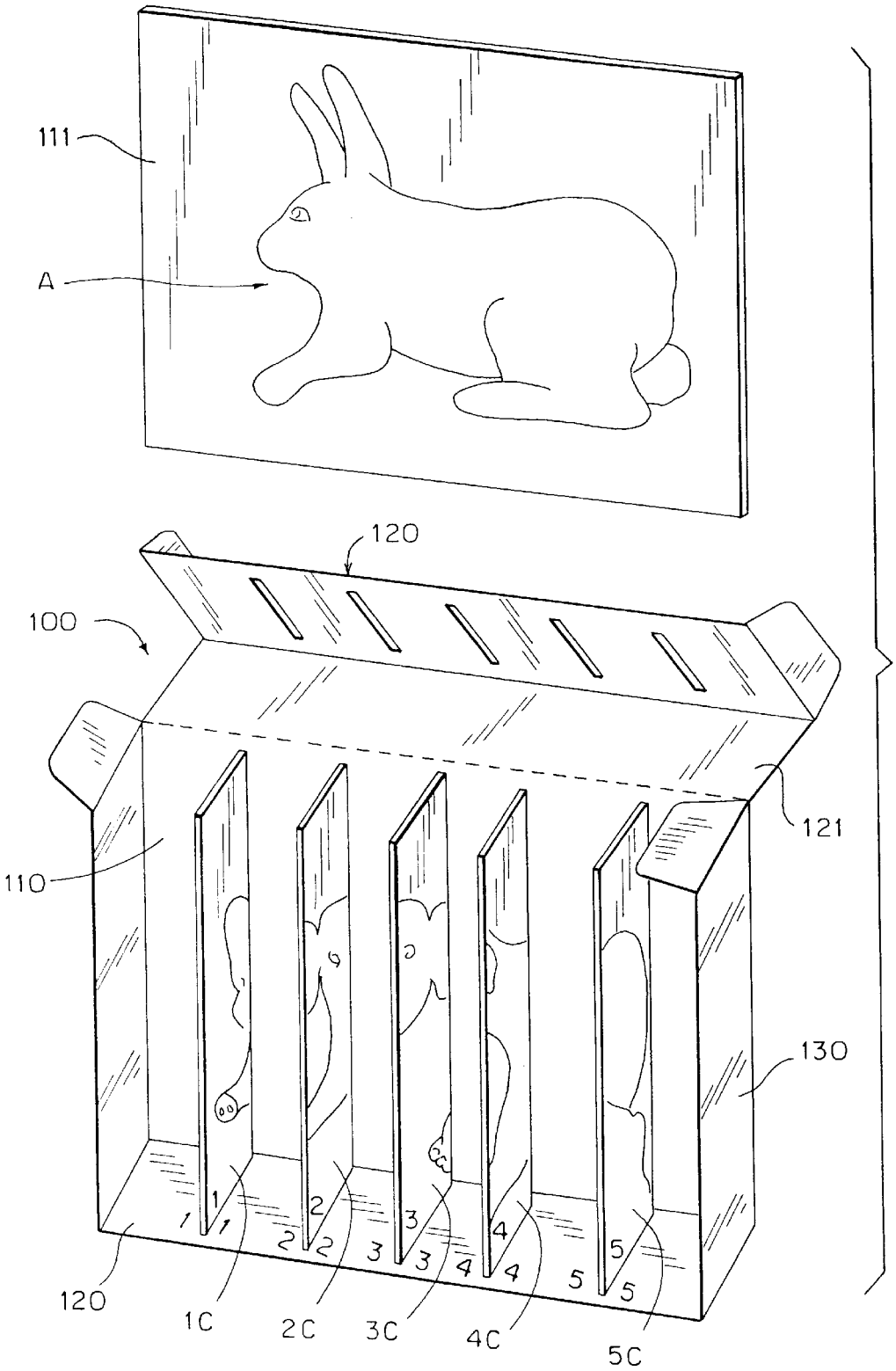
FIG. 3 is a partially-exploded view similar to that of FIG. 1, but from the other side, showing different indicia bearing panels and a back sheet.

The inner face of the main sheet 110 also includes pictorial indicia, such as the rabbit A shown in FIGS. 1 and 3. The picture is preferably printed on a separate sheet 111 as shown in FIG. 3, which sheet 111 is laid over the bottom 110 of the tray and supported on the bottom 110 by the panels and/or other means. The base 110 itself may be blank in this case; this permits a variety of pictures for straight-on viewing on various sheets 111. The picture A appears when the box frame 100 is viewed straight on (perpendicular to the substrate or tray bottom 110); the panels then appear as thin lines without significantly disturbing the face picture A.

Figure 4:
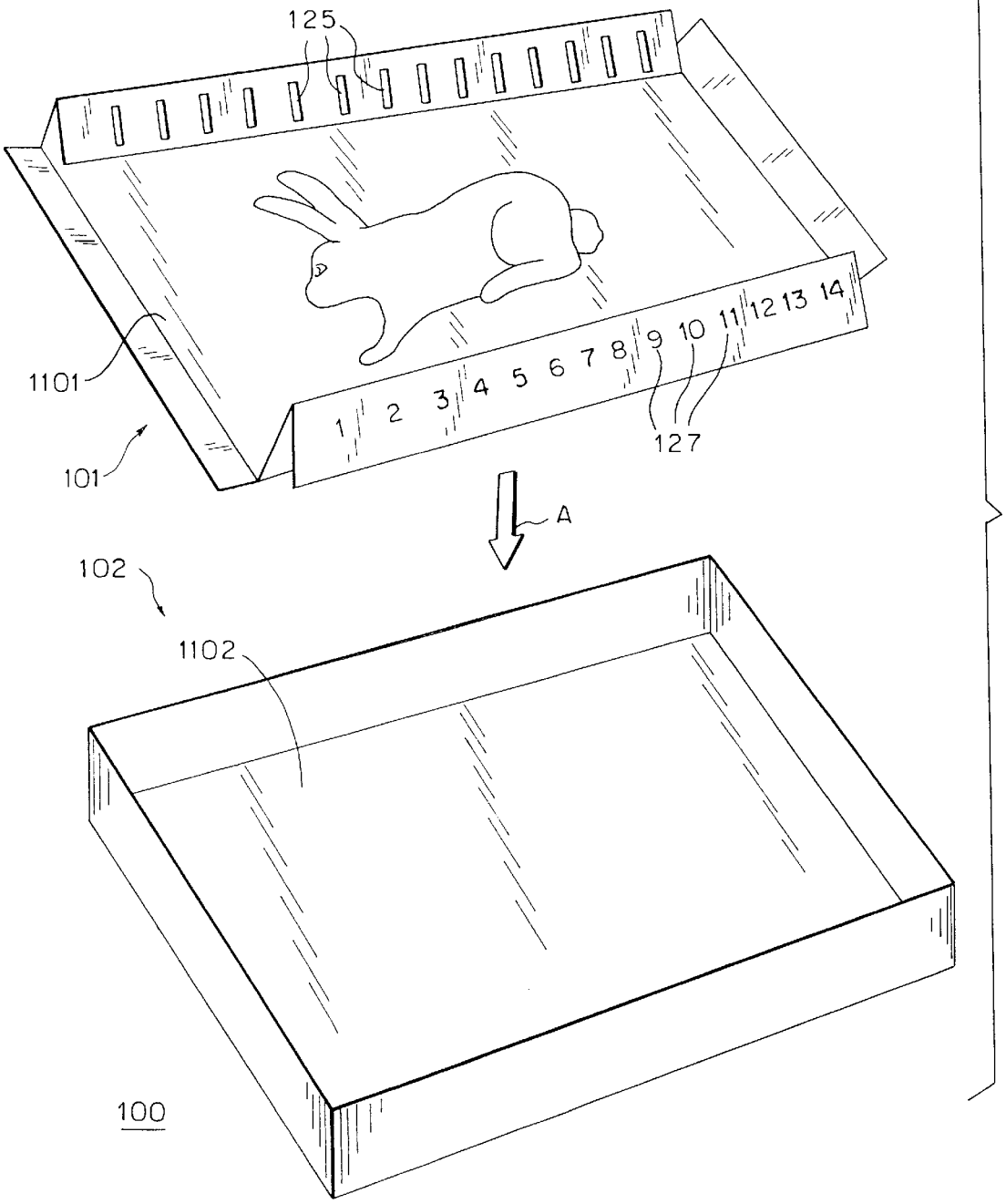
FIG. 4 is a perspective, exploded view of a second preferred embodiment of the present invention.

The panels 1B, 2B, etc. may be inserted into the slots 125 by slightly bending them and letting them straighten into the slots 125. The correct sequence is made easy for children with assembly or guide indicia or markings 127 appearing on both the panels and the sides 120, which are sequential numbers in FIG. 1. While the guide markings 127 may be placed on the inside of the tray 100 as shown in FIGS. 1 and 3, such guide markings 127 are preferably placed on the outside as shown in FIG. 4. The assembly markings may be omitted from the upper one of the sides 120, or, the numbers may be duplicated on the outside of the upper side (i.e. on the portion of the sub-side 122 that is hidden in FIG. 1).

Since there are preferably two panel pictures corresponding to the two panel sets B and C, in addition to the background picture A, the indicia are preferably color coded for sets B and C. For example, numbers on the B panel set might be red, and those on panel set C might be blue. The corresponding assembly numbers on the sides 120 can be colored to match. Thus, if a child inserts the panels so that a red "1" on a panel is next to a red "1" on a side, then correct assembly of the panels is facilitated. It is noted that any means for mounting the panels in the predetermined sequence for creating a picture is within the scope of the invention, and that such means include the mere provision of slots or other panel mounts arrayed in such a way that the panels can be disposed to create the picture; assembly indicia may be provided but are not needed in the present invention. In fact, lack of any assembly indicia merely makes the task of mounting the panels in the predetermined sequence more challenging, which may be appropriate for older children.

FIG. 1 shows pictorial indicia B' on the right-hand end 130 forming the end part of the picture of the panel set B. This side indicia B' may be omitted.

The pictorial indicia of the invention can be pre-printed, or left blank for free-hand artwork prior to assembly, but the preferred pictorial indicia are outlines suitable for coloring. The kit may include crayons and/or scrapers for crayon smoothing and blending of colors as well as the removal of excess crayon wax, pencils and/or erasers, colors which appear when wetted, or any similar type of pictorial apparatus or set-up, especially those popular with children.

In order to prepare the pictures prior to inserting the panels, the user may lay the sheets from which the panels are to be formed on a flat surface to draw, color, decorate with sparkles or stickers, and so on. The kit of the invention provides a plurality of sheets 200 for coloring or the like, each panel set being preferably provided in the form of a sheet which are easily separated, e.g. by perforations, into the individual panels for mounting in the box frame.

Two separate sets of panels may be set into the box frame after the child has applied color or other indicia on the sheets 200 and has then separated the sheets into the two sets of panels. Thus, after the colored or otherwise decorated panels have been prepared, they are inserted as shown in FIG. 1. If the panel width times the number of panels is less than the interior length of the frame, then a quoin may be included in the kit. One side may be opened to provide enough width, as seen in FIG. 1. Then the user may move left and right to see the three pictures.

The invention contemplates panels which are pre-printed and need no additional artwork, but in which the assembly markings are omitted so that the user must exert extra effort to place the many panels into the proper order and/or orientation. Such an embodiment may include highly detailed or geometric designs, e.g. kaleidoscope.

Auxiliary stiffening members (not shown) may be provided for reinforcing the panels.

Besides the illustrated box frame 100, any other sort of substrate is within the scope of the invention. In particular, a semi-rigid or rigid flat sheet may be provided with means for mounting the panels directly on its surface. That is, the sides are omitted and the panels are mounted to the substrate by their edges rather than by their ends; or, a separate panel end-holder can be provided.

FIG. 4 shows a second and more preferred embodiment of the present invention, in which the box frame 100 is provided in two parts, an insert or platform 101 and a box tray 102 into which the platform is inserted and resides. The arrow A in FIG. 4 indicates that the insert 101 rests in the box tray 102 when the kit is assembled. The box tray 102 may be permanently formed as a tray to support the platform 101, and the platform 101 may be simplified since it need not be so stiff. For example, the tabs 129 and 139 shown in FIG. 1 may be omitted; in addition, the ends 130 may also be omitted from the insert 101 if desired. Supported in the box tray 102, the platform insert 101 may still function as a substrate when constructed of lighter material.

In the embodiment of FIG. 4, the base 110 preferably comprises two superimposed bases, 1101 (of the insert 101) and 1102 (of the box tray 102). Although rabbit indicia is shown in FIG. 4 on the face of the base 1101, such indicia can be and preferably is omitted from the base 1101 and instead placed on a separate sheet 111 like that shown in FIG. 3.

Figure 5:
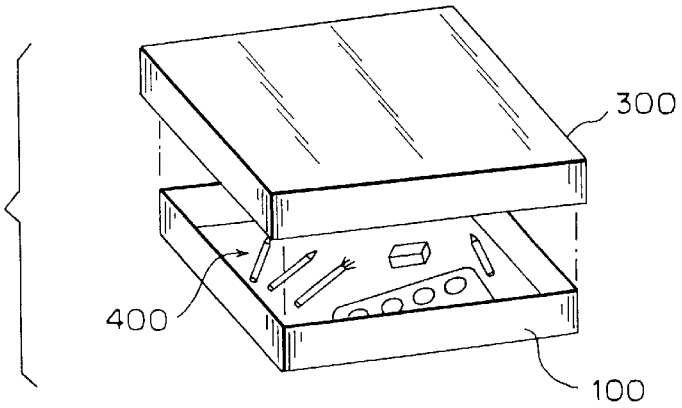
FIG. 5 is a perspective, exploded view showing a cover and utensils.

It is also within the scope of the invention to enclose the box frame 100 (or the box tray 102) within an outer cover of similar shape and thickness but slightly greater length and width, so that it snugly covers the box frame; this is shown in FIG. 5, where a cover 300 encloses the box frame 100. Such nesting tray construction is common with commercial games. In this case the auxiliary parts and utensils 400 of the kit of the invention, such as crayons, scraper, sparkle, stickers, instruction book, and so on, can be packaged between the box frame 100 and the outer cover 300.

It is to be noted that the panels may be set at any angle to the substrate, not only at the right angles shown in the drawing. If the substrate is a flat sheet rather than a box frame, then the panels may be joined with each other and the substrate to form triangular tubes, which would stiffen the structure. Naturally, the angles of the two sides could differ. Corresponding panels of the two panel sets could then be formed as strips folded down the middle, with tabs for insertion into the substrate.

The invention contemplates other embodiments and variations within the scope of the claims, such as for example one or more folded sheets having panels separated by folds, where each panel's indicia comprises part of a picture but pictures are not continuous across the folds, or where the panels and a substrate image surface comprise a single accordion-fold sheet with or without equal fold spacing.

The expressions "means to . . . " and "means for . . . " as may be found in the specification above and/or in the claims below, followed by a functional statement, are intended to define and cover whatever structural, physical, chemical or electrical element or structure may now or in the future exist for carrying out the recited function, whether or not precisely equivalent to the embodiment or embodiments disclosed in the specification above; and is intended that such expressions be given their broadest interpretation.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. A picture kit comprising:

a box frame having two sides;

one or more panel sets, each panel set further comprising a plurality of panels; and panel mounts for mounting the panels of a particular panel set onto the two sides at a mounting angle special to the particular panel set;

whereby, when the box frame is viewed at an angle to the mounting angle, essentially only one of the panel sets is visible such that pictorial indicia disposed thereon in a predetermined sequence present a coherent picture;

wherein the box frame includes a base having base edges, the sides are foldably joined to the base edges, and each of the sides includes a plurality of the panel mounts;

wherein each of the sides further comprises bifold subsides, and the panel mounts include slots through the sides sized to accept ends of the panels.

2. The kit according to claim 1, wherein the box frame comprises a box tray and a nesting platform, and wherein the platform comprises the base and sides.

3. The kit according to claim 1, wherein the base and the sides are delimited by a crease therebetween.

4. The kit according to claim 1, comprising ends, wherein the base includes end edges, and wherein the ends are foldably joined to the end edges.

5. The kit according to claim 1, comprising assembly indicia indicating the predetermined sequence.

6. The kit according to claim 5, wherein the assembly indicia comprise corresponding marks on the sides and the panels.

7. The kit according to claim 6, wherein the marks include color-coding corresponding to the panel sets.

8. The kit according to claim 1, comprising utensils selected from the group consisting of marking utensils, coloring utensils, and erasing utensils.

9. A picture kit comprising:

a box frame having two sides;

one or more panel sets, each panel set further comprising a plurality of panels; and panel mounts for mounting the panels of a particular panel set onto the two sides at a mounting angle special to the particular panel set, the mounting angle being substantially at a right angle to a plane of the box frame;

whereby, when the box frame is viewed at an angle to the mounting angle, essentially only one of the panel sets is visible such that pictorial indicia disposed thereon in a predetermined sequence present a coherent picture;

wherein each of the sides further comprises bifold subsides, and the panel mounts include slots through the sides sized to accept ends of the panels.

* * * * *